United States Patent [19]

Keithley

[11] Patent Number: 4,771,559

[45] Date of Patent: Sep. 20, 1988

[54] EXTRUDED ALUMINUM SIGN FRAME SECTION

[76] Inventor: Cliff Keithley, P.O. Box 1041, Dickinson, N. Dak. 58601

[21] Appl. No.: 1,803

[22] Filed: Jan. 8, 1986

Related U.S. Application Data

[62] Division of Ser. No. 718,176, Apr. 1, 1985, Pat. No. 4,674,213.

[51] Int. Cl.[4] ..... G09L 7/00

[52] U.S. Cl. ..... 40/603

[58] Field of Search ..... 40/617, 156, 564, 152, 40/603, 13; 160/371, 372, 374

[56] References Cited

U.S. PATENT DOCUMENTS

| | | | |
|---|---|---|---|
| 4,317,302 | 3/1982 | Von De Linde | 40/603 |
| 4,542,605 | 9/1985 | Gandy | 40/603 |
| 4,554,754 | 11/1985 | Stilling | 40/603 |
| 4,674,213 | 6/1987 | Keithley | 40/603 |
| 4,674,214 | 6/1987 | Gandy | 40/156 |

*Primary Examiner*—Gene Mancene
*Assistant Examiner*—Wenceslao J. Contreras
*Attorney, Agent, or Firm*—Merchant, Gould, Smith, Edell, Welter & Schmidt

[57] ABSTRACT

A frame for mounting a flexible sign and said brake comprising an arrangement of extruded aluminum frame members of relatively simple arrangement.

2 Claims, 2 Drawing Sheets

EXTRUDED ALUMINUM SIGN FRAME SECTION

This is a division of application Ser. No. 06/718,176, filed Apr. 1, 1985, now U.S. Pat. No. 4,674,213.

BACKGROUND OF THE INVENTION

1. Field of the Invention

The invention of the present application relates generally to the field of extruded sign frame sections. More particularly, this invention relates to a device which may be used as a frame for flexible faced signs, canopies and related applications, where the display surface is made of a flexible cloth material.

2. Description of Related Technology

The modern sign industry has been revolutionized by the development of soft, cloth-like, stretchable fabric materials for use as a display face. One such material is marketed by the 3M Company under the trademark "PANAFLEX", and has a weight comparable to that of heavy canvas. It presents a smooth surface and is translucent, allowing for internal illumination. This material is a polyvinyl chloride which is reinforced with glass fibers that are woven into the material in a pattern resembling that of a rectangular grid. As a consequence of the manner of fabrication, it is virtually impossible to tear the material. Even if the material is cut, the cut is difficult to extend by further tearing. If the material is cut, the perforation can easily be patched in the field in a manner similar to and no more difficult than applying a patch to an innertube. The material is capable of withstanding substantial wind loads.

When used as a sign face material, the fabric must be mounted in some sort of framework. One sign may weigh several thousand pounds. Frequently, such a sign will have a display face area of hundreds of square feet. The framework must be extremely rugged to support the weight of a larger sign and to withstand high winds.

In order to achieve the ruggedness necessary for larger signs, such signs have long been fabricated as steel frameworks. Improvements in sign framework construction have been made during recent years through the use of aluminum extrusions to form the cabinet and to serve as a base for mounting the components used to support the display face. The use of aluminium results in a substantial decrease in weight and a reduction in the rate of frame corrosion.

Extruded aluminum shapes are now quite commonly employed in the construction of sign frames. Literally thousands of extruded aluminum shapes are available to the sign industry, the large number of shapes available serving as evidence of a continuing search in the industry for improvement and a lack of satisfaction with presently available designs. The fundamental problem relates to the difficulty in easily and securely fastening the flexible sign face material to the frame extrusion.

The conventional manner of mounting flexible translucent sign faces, such as "PANAFLEX," requires a relatively complicated clamping arrangement for securing the perimeter of the sign face to the sign frame or body and for adjusting the tension in the face at installation. In order to improve the appearance of display signs using the "PANAFLEX" sign facing material and standard mounting structure, additional relatively complicated framing has been required to support and also conceal the sign face mounting structure. Typical mounting systems utilize a number of components that must interact, creating added expense and requiring that a large inventory be maintained by the typical sign fabricator in order to respond to the special requirements of each particular sign. The large number of mounting components involved has caused modern sign fabrication to be unnecessarily labor intensive. The absolute amount of materials required to fabricate a single sign has also become excessive.

An example of the current state of the art relating to aluminium sign frame extrusions is disclosed in U.S. Pat. No. 4,317,302, issued to Von De Linde on Mar. 2, 1982. Von De Linde discloses a number of frame and clamp assemblies used to construct a flexible faced sign and to keep the sign face material under tension. In particular, Von De Linde utilizes a clamp assembly 37 which has since become the industry standard and which is also utilized by the present invention. The Von De Linde system utilizes a large number of stabilizing and interconnecting components, and also teaches the use of special tool 96 to assist with the final assembly of the sign.

One problem common to many such prior art flexible sign facing mounting systems is the difficulty with which such systems can be adapted or "retrofitted" to existing signs. Previously known systems require that existing signs be substantially dismantled if a flexible sign facing is to be applied. A large number of components would also need to be added to an existing sign to enable the conversion to a flexible sign face.

The goal of extrusion designers has since been to provide a simpler mounting structure for flexible sign facing, particularly for back lighted signs where the facing support structure should be relatively uncomplicated, compact, and lightweight without sacrificing structural strength and the ability to withstand high wind loads. The present extrusions available to the sign industry do not lend themselves to sign structures which are easy to assemble initially and which are readily servicable for changing lighting or performing other maintenance operations.

SUMMARY OF THE INVENTION

The present invention provides an improved sign frame extrusion for use with flexible sign facing which is structurally simple and which also eliminates the need for the large number of components required by prior art sign structures. Compared to currently employed systems, the present invention is quite inexpensive.

The present invention is particularly adapted to providing an improved mounting frame for flexible sign facing of the type manufactured and sold under the trademark "PANAFLEX" and similar types of sign facing in which a relatively mechanically simple mounting frame is provided which substantially reduces the cost and complexity of the sign structure. The inherent strength of the extrusion of the present invention completely eliminates the need for internal frame bracing on relatively small signs. The structural simplicity of the present invention also permits relatively straightforward conversion of existing non-flexible signs to a flexible sign face material.

In accordance with one aspect of the present invention, there is provided a support frame extrusion for flexible sign facing comprising a light-weight aluminum member having a cross-section compatibly shaped to support a standard cloth tensioning element. The extrusion of the present invention is compatibly shaped to facilitate mounting the extrusion to a parent support member. Internal support members which are formed integrally with the extrusion provide stability for the flexible faced sign material and provide support and protection for wiring included within the sign as required for its illumination. A stabilizing element is provided to dampen movement of the sign face material and to reduce stress on the sign face tensioning elements. Another embodiment of the extrusion of the present invention permits the construction of a flexible faced sign which has a "borderless" appearance.

The invention of this application is thus an apparatus for addressing problems existing in the prior art. Specific advantages of the invention will become apparent with reference to the accompaning Drawings, Detailed Description of the Invention and the Claims.

DESCRIPTION OF THE PREFERRED EMBODIMENT

Figure 1:
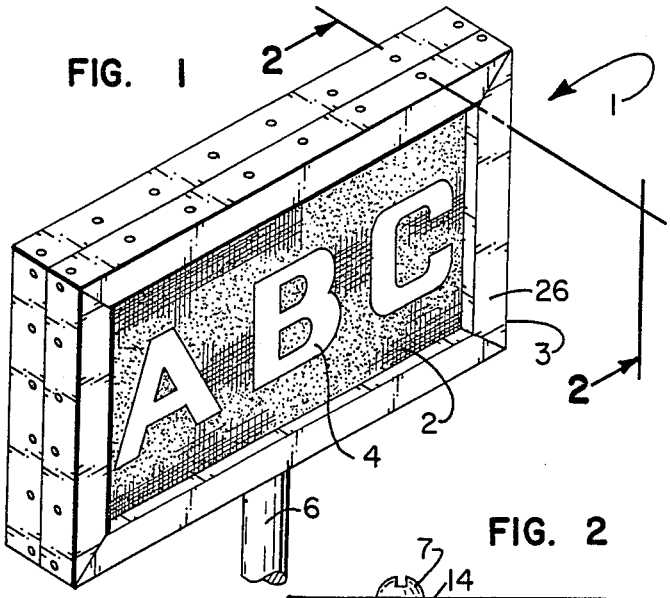
FIG. 1 is a perspective view of a sign utilizing a frame according to the present invention.

As shown in FIG. 1, a sign constructed of an extruded frame according to the present invention is depicted generally at 1. The flexible sign face material 2 is stretched across the frame 3, displaying whatever information 4 may be imprinted upon it.

Figure 2:
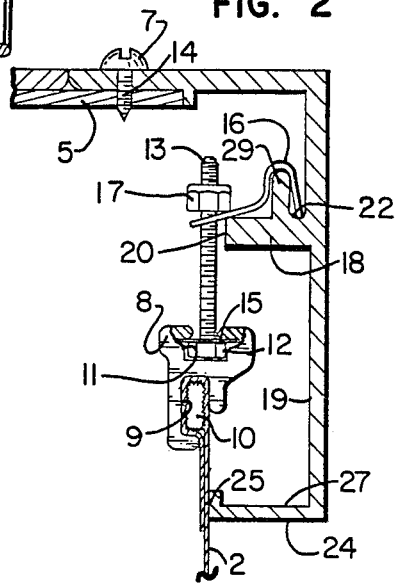
FIG. 2 is a cross sectional view of a preferred embodiment of the present invention corresponding to the frame depicted in FIG. 1, as seen from the lines 2—2 of FIG. 1.

As depicted in FIG. 2, the frame 3 includes an orifice 14 which may be used to facilitate attachment of the frame 3 to a rigid support structure 5. The rigid support structure 5 may be an existing sign which may be left in place when frame 3 is attached. The existing sign and existing rigid support structure 5 would remain concealed beneath the new sign 1.

The frame 3 is constructed in any convenient shape, such as the rectangle shown in FIG. 1, such that a closed, continuous frame is created, across which the sign face material 2 may be stretched. The support structure 5 may then be affixed to a permanent mounting structure, such as pole 6. A suitable fastener, such as screw 7, may be inserted through orifice 14, thereby rigidly attaching frame 3 to support structure 5.

The sign face material 2 is held in tension across frame 3 by means of gripping element 8. Gripping element 8 includes a channel 9 within which a toothed gripping bar 10 may be inserted. The sign face material 2 is wrapped around gripping bar 10 prior to insertion within channel 9. Upon insertion of toothed gripping bar 10 into channel 9, the sign face material 2 is frictionally pressed against channel 9 and cannot be removed from channel 9 without again withdrawing toothed gripping bar 10 from channel 9.

Grooved channel 11 is contained within gripping element 8 and is of sufficient size to house the head 12 of bolt 13. Washer 15 is also placed within grooved channel 11 to assist in retaining the head 12 within grooved channel 11. Bolt 13 passes through a hooked member 16 which is confined to bolt 13 by nut 17.

The extrusion of the present invention contains a projection 18 which extends substantially perpendicularly from the inner surface 19 of frame 3. A knob 29 extends substantially perpendicularly from the surface of projection 18. The knob 29 serves as an anchor for hooked member 16. In operation, the sign face material 2 is inserted into gripping element 8 by means of gripping bar 10. The hooked member 16 is then placed over knob 29. The identical operation is performed at the opposite side of frame 3 by means of an identical tensioning element. The sign face material 2 is then made taut by tightening nut 17 against hooked member 16, thereby urging gripping element 8 toward projection 18. This tightening operation may be performed until the sign face material 2 is taut and wrinkle free.

A stabilizing element 24 also extends perpendicularly from inner wall 19, paralleling projection 18. Stabilizing element 24 serves three purposes. First, stabilizing element 24 is a longitudinal stiffener for the entire frame 3, thereby resisting any bending, torsional or vibrational motions that may be transmitted to the frame 3, especially under conditions of high winds. Second, the shelf surface 25 of stabilizing element 24 serves as a bearing surface abutting sign face material 2, thereby tending to dampen any movement induced in the sign face material 2 and maintaining the sign face 2 within the desired plane, that is, parallel to the plane defined by border 26 of frame 3. Third, top channel 27 of stabilizing element 24 serves as a support surface for any internal wiring that may be necessary for purposes such as sig illumination.

The dimensions of projection 18 are carefully chosen such that end wall 20 extends beneath the edge of nut 17, thereby providing a suitable bearing surface for hooked member 16 as it is stressed under the tension exerted by the taut sign face material 2. The knob 29 is positioned along projection 18 such that the end 21 of hooked member 16 is confined within slot 22, which is formed by the space between knob 29 and inner surface 19 of frame 3.

Typically, projection 18 extends a distance of 29/32 inches from inner surface 19. Knob 29 typically extends a distance of $\frac{1}{2}$ inch from the upper surface 23 of projection 18. The thickness of knob 29 is typically 5/32 inch, and the width of slot 22 is typically $\frac{1}{8}$ inch. All of these dimensions are selected to provide optimum compatibility with hooked member 16, which is available throughout the flexible faced sign industry in a single, standardized size and shape.

The dimensions of stabilizing element 24 are carefully chosen to accomplish its multiple functions. The distance from inner wall 19 to shelf surface 25 is typically 1 inch. This latter dimension, combined with the placement of knob 29 or projection 18, results in the proper alignment of sign face material 2 with shelf surface 25, as is essential if shelf surface 25 is to properly perform its stabilizing function. Shelf surface 25 typically has a height of $\frac{1}{4}$ inch. The thickness of stabilizing element 24 is 3/32 inch.

Figure 3:
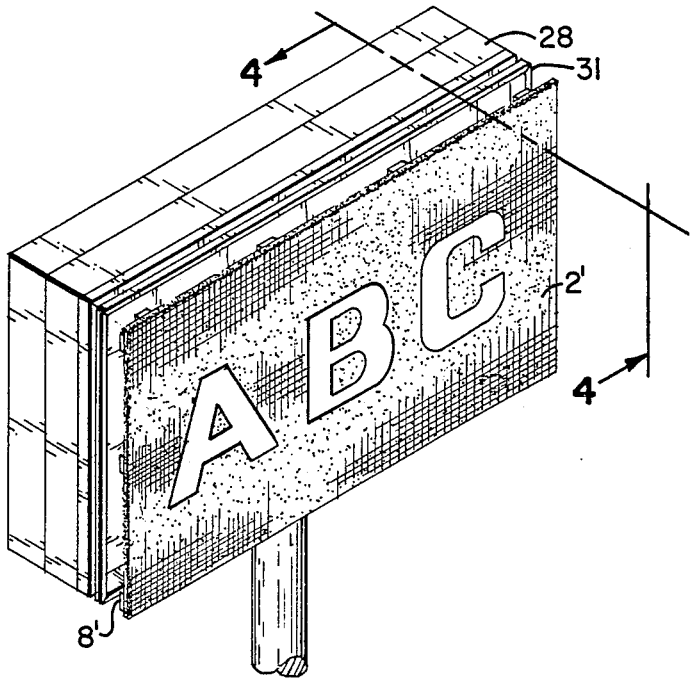
FIG. 3 is a perspective view of a sign utilizing an alternate embodiment of the present invention.

Another embodiment of the present invention includes a frame 31, as shown in FIG. 3. Frame 31 includes a mounting surface 30 which may be attached to an existing sign or rigid mounting structure 28. The foot 32 of frame 31 extends perpendicularly from inner wall 33 of frame 31. Inclined member 34 is an extension of foot 32 and extends in a direction away from inner wall 33 for a distance which is sufficient to bring tip surface 35 of inclined member 34 to a point slightly above the upper lip 36 of frame 31.

In operation, gripping element 8' is placed on inclined surface 37 such that flexible sign face material 2' is draped over tipped surface 35 such that the material 2' resides in a plane parallel to the plane defined by mounting surface 30. Hooked member 16' is placed over finger 38. The identical operation is formed at the opposite side of frame 31 by means of an identical tensioning element. The sign face material 2' is then made taught by tightening nut 17' against hooked member 16', thereby urging gripping element 8' toward foot 32. This tightening operation may be performed until the sign face material is taught and wrinkle free.

Figure 4:
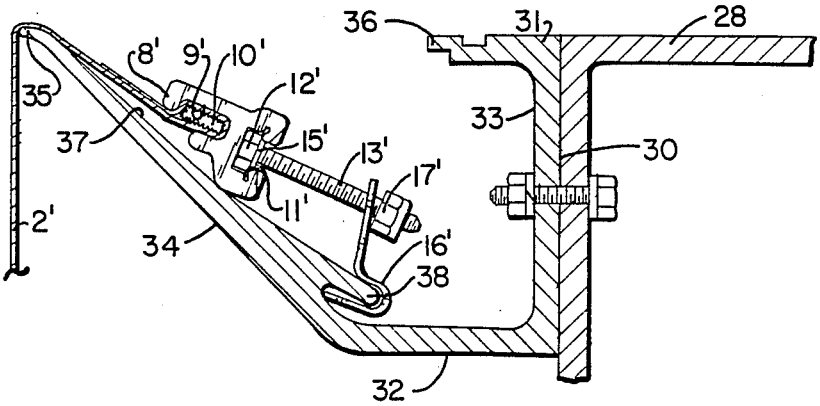
FIG. 4 is a cross sectional view as seen from the lines, 4—4 of FIG. 3.

The dimensions of the various elements of frame 31 are carefully selected to provide a "borderless" appearance of the completed sign, as shown in FIG. 4. Thus, when the sign face material 2' is viewed "head on" by an observer, its means of support is completely concealed.

Typically, inclined member 34 forms a 45° angle with a plane that is parallel to foot 32. Normally, foot 32 extends outwardly a distance of $2\frac{1}{4}$ inches from the mounting surface 30. The length of inclined member 34 is usually $4\frac{5}{8}$ inches. The thickness of inclined member 34 varies from $\frac{1}{4}$ inch at the point where it joins foot 32 to $\frac{1}{8}$ inch in the region of tip surface 35. The nominal length of finger 38 is $\frac{1}{2}$ inch.

The use of frame 31 or frame 3 may be described as follows. The first step in constructing the sign is to lay the sign face material 2 (or 2') on a floor or large table, and to place the assembled frame 3 or 31 on the sign face material 2. The sign face material 2 is then marked with a marking pen around the inside of the frame. The frame is then lifted and another set of marks is made parallel to the original marks offset by a distance of 2 inches. The second line represents the line along which the sign face material 2 is folded within gripping element 8. At this point, the sign face material 2 may be decorated. The sign face material may then be cut along the outer, larger mark, and gripping element 8 may be installed at appropriate points along the edges of sign face material 2. Hooking element 16 (or 16') may then be attached to the knob 29 or finger 38 and nuts 17 (or 17') may be tightened as required to achieve a smooth wrinkle free face. The frame with the completed sign face is now ready to be installed on a suitable support. The face and frame may be installed on a new sign cabinet or placed on an existing sign.

While only a limited number of embodiments have been illustrated and described, many other variations may be made in a particular design and configuration without departing from the scope of the invention as set forth in the appended claims.

I claim:

1. A sign frame for securing flexible sheets under tension with a hooked tensioning element, tightened by means of a nut and bolt, comprising:

(a) a face plate, the face plate having a top edge, a bottom edge and an inner wall;

(b) a mounting plate, the mounting plate having a lower surface, the mounting plate being formed integrally with and extending longitudinally along the top edge of the face plate, the mounting plate being substantially perpendicular to the face plate and containing a plurality of holes;

(c) a projection, the projection having a protruding edge, the projection being formed integrally with the face plate and extending longitudinally along and being substantially perpendicular to the inner wall of the face plate, the projection located a distance from the mounting plate sufficient to permit the hooked tensioning element to be mounted and adjusted;

(d) a knob, the knob being formed integrally with, extending longitudinally along and being substantially perpendicular to the projection, the knob extending toward the mounting plate and the knob located a distance from the face plate sufficient to restrain the hooked tensioning element between the knob and the face plate, and located a distance from the protruding edge of the projection so as to allow the protruding edge of the projection to engage the nut of the tensioning element;

(e) a rib, the rib extending longitudinally along the lower surface of the mounting plate and located between the plurality of holes and the face plate;

(f) a stabilizing plate, the stabilizing plate having a trailing edge, the stabilizing plate being formed integrally with the face plate and extending longitudinally along and being substantially perpendicular to the face plate, the stabilizing plate extending a distance from the face plate sufficient to engage the flexible sheet; and (g) a bearing plate, the bearing plate being formed integrally with and extending longitudinally along the trailing edge of the stabilizing plate, the bearing plate being substantially perpendicular to the stabilizing plate.

2. A sign frame as defined in claim 1 wherein a channel is created between the projection, the face plate and the stabilizing plate, of sufficient size to include wiring.

* * * * *